US009309857B2

(12) United States Patent
Martinez et al.

(10) Patent No.: US 9,309,857 B2
(45) Date of Patent: Apr. 12, 2016

(54) FUEL IGNITION SYSTEMS WITH VOLTAGE REGULATION AND METHODS FOR SAME

(75) Inventors: Juan Antonio Martinez, Watertown, MA (US); Eugene M. Freidline, Needham, MA (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 968 days.

(21) Appl. No.: 13/395,157

(22) PCT Filed: Sep. 10, 2009

(86) PCT No.: PCT/US2009/056527

§ 371 (c)(1),
(2), (4) Date: Mar. 9, 2012

(87) PCT Pub. No.: WO2011/031263

PCT Pub. Date: Mar. 17, 2011

(65) Prior Publication Data

US 2012/0171628 A1 Jul. 5, 2012

(51) Int. Cl.

| | |
|---|---|
| ***F23Q 3/00*** | (2006.01) |
| ***F23N 5/00*** | (2006.01) |
| ***F02P 3/04*** | (2006.01) |
| ***F02P 3/08*** | (2006.01) |
| ***F02P 17/02*** | (2006.01) |

(52) U.S. Cl.

CPC ..... *F02P 3/0428* (2013.01); *F02P 3/083* (2013.01); *F02P 3/0853* (2013.01); *F02P 17/02* (2013.01)

(58) Field of Classification Search

CPC ..... F02P 3/0428; F02P 3/083; F02P 3/0853; F02P 17/02

USPC ..... 361/253

See application file for complete search history.

(56) References Cited

U.S. PATENT DOCUMENTS

| | | | | |
|---|---|---|---|---|
| 3,273,019 | A * | 9/1966 | Matthews | 431/45 |
| 5,049,786 | A * | 9/1991 | Gotisar et al. | 315/209 CD |
| 5,865,612 | A * | 2/1999 | Hill et al. | 431/67 |
| 2006/0257805 | A1 * | 11/2006 | Nordberg et al. | 431/28 |

OTHER PUBLICATIONS

International Preliminary Report on Patentability mailed May 1, 2012.

International Search Report and Written Opinion mailed Oct. 20, 2009.

* cited by examiner

*Primary Examiner* — Thienvu Tran
*Assistant Examiner* — Kevin J Comber
(74) *Attorney, Agent, or Firm* — Cantor Colburn LLP

(57) ABSTRACT

Embodiments of ignition systems, apparatus, and/or methods can provide exemplary voltage control or regulation for a voltage used for flame detection as well as for spark generation. In one embodiment, flame sensitivity and spark energy can have an increased resistance to component, temperature, and/or power supply variations.

14 Claims, 4 Drawing Sheets

FUEL IGNITION SYSTEMS WITH VOLTAGE REGULATION AND METHODS FOR SAME

FIELD OF THE INVENTION

This invention relates generally to the field of ignition systems such as direct spark ignition systems and hot surface ignition systems and methods of operating the same.

BACKGROUND OF THE INVENTION

This invention relates generally to gas or other fuel-fired appliances and more particularly to electronically igniting a burner and detecting or proving the existence of flame after ignition.

SUMMARY OF THE INVENTION

An object of the application is to address problems in the related art and/or to provide advantages disclosed herein in whole or in part.

In view of the background, it is an object of the application to provide a microcontroller based direct spark ignition control.

Another object of the application is to provide a microcontroller based hot surface ignition control.

One embodiment according to the application can include a controller for an ignition system. The controller can provide a regulated voltage level for at least one of a flame sense voltage or a spark voltage in an ignition system.

In one aspect, embodiments of the application provide a spark ignition system that can include a comparator to compare a first voltage set point and a feedback value to output a difference value, a controller to receive the difference value of the comparator to generate a correction signal, a pulse width modulation (PWM) circuit coupled to the controller to receive the correction signal and configured to generate an output voltage level, a DC/DC voltage converter coupled to receive the output voltage level from the PWM circuit and configured to generate a regulated flame sense and spark voltage, a flame sense circuit coupled to receive the regulated flame sense and spark voltage and configured to detect a status of a burner flame, the flame sense circuit to output a sensed flame signal to the controller, a feedback circuit coupled to receive the regulated flame sense and spark voltage and generate the feedback value representative of a current regulated flame sense and spark voltage level for output to the comparator, and a second voltage converter coupled to the controller and coupled to receive the regulated flame sense and spark voltage, the second voltage converter to output an increased corresponding voltage for a spark igniter, the controller to regulate the regulated flame sense and spark voltage to a prescribed level.

In one embodiment, a spark ignition system can regulate the regulated flame sense and spark voltage to reference levels such as 100 volts, 120 volts, 130 volts, 140 volts, 150 volts 160 volts, or 200 volts.

In one embodiment, a spark ignition system can regulate the regulated flame sense and spark voltage within 1 volt, 2 volts, or 5 volts or less than 1%, 2% or 5% of the prescribed level.

In one aspect, embodiments of the application provide a method of operating a spark ignition system that can include comparing a voltage set point with a feedback signal to output a first control signal, generating a voltage level control signal responsive to the first control signal, converting an input voltage to a regulated control voltage using a first voltage converter, where said converting is responsive to the voltage level control signal, detecting a status of a burner flame using the regulated control voltage to output a sensed flame signal to a controller, receiving the regulated control voltage and generating the feedback signal using a feedback circuit, and receiving the regulated control voltage and converting the regulated control voltage to a spark voltage for a direct spark igniter using a second voltage converter.

In one aspect, embodiments of the application provide an ignition system that can include a comparator to compare a first voltage set point and a feedback value to output a correction value, a controller to receive the correction value of the comparator to generate a control signal, a voltage controller circuit coupled to the controller to receive the control signal and configured to generate an output voltage level, a DC/DC voltage converter coupled to receive the output voltage level from the voltage controller circuit and configured to generate a regulated voltage, a flame sense circuit coupled to receive the regulated voltage and configured to detect a status of a burner flame, the flame sense circuit to output a sensed flame signal to the controller, a feedback circuit coupled to receive the regulated voltage and generate the feedback value representative of a current regulated voltage level, and a second voltage converter coupled to the controller and coupled to receive an enable signal from the controller, the second voltage converter to output a corresponding voltage for an igniter circuit, the controller to regulate the regulated voltage to a prescribed level responsive to the feedback value.

BRIEF DESCRIPTION OF THE DRAWINGS

Novel features that are characteristic of exemplary embodiments of the invention are set forth with particularity in the claims. Embodiments of the invention itself may be best be understood, with respect to its organization and method of operation, with reference to the following description taken in connection with the accompanying drawings in which:

DETAILED DESCRIPTION OF EXEMPLARY EMBODIMENTS

Figure 1:
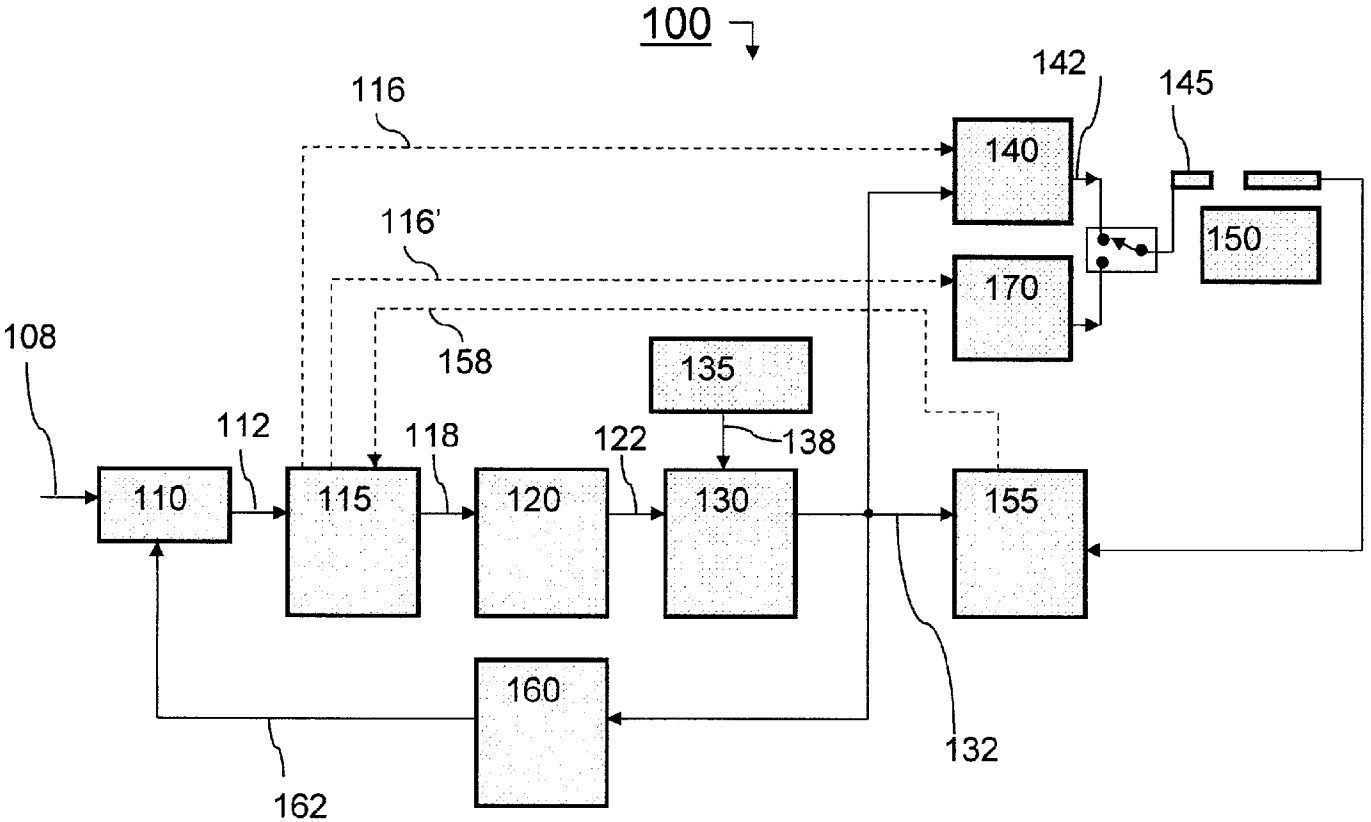
FIG. 1 is a block diagram that shows an embodiment of a spark ignition system and flame sensing system according to the application.

Reference will now be made in detail to exemplary embodiments of the application, examples of which are illustrated in the accompanying drawings. Whenever possible, the same reference numerals will be used throughout the drawings to refer to the same or like parts.

Embodiments according to the application can provide apparatus and methods for microcontroller based direct spark ignition (DSI) control. In DSI control, a spark igniter uses or requires a high voltage (e.g., 15 KV) to produce an arc for the gas to ignite. The high voltage can be the output of an ignition transformer (e.g., second voltage converter) as known to one skilled in the art. The ignition transformer can raise a midlevel voltage to the high voltage required to produce an arc. For example, in a recreation vehicle environment, where the supply voltage is 12 VDC, a first voltage converter such as a voltage doubler or a step-up transformer as known to one skilled in the art can be used to provide a midlevel alternating voltage, which can reduce the size of the ignition transformer. In embodiments, according to the application, the midlevel voltage can be regulated or controlled and also used for flame detection.

Flame detection is based on a flame rectification technique. A flame rectification probe can be used for flame detection because an active flame acts as a plasma diode. A unidirectional current can flow from a probe within the flame to the metal casing of the burner, e.g., the firebox. The flame itself thus acts like a resistance and diode connected in series. By applying an alternating current to the rectification probe, it is possible to detect the presence of flame.

However, the flame detection sensitivity is a function of the voltage amplitude. Further, in methods used to boost voltage without sufficient voltage regulation, the flame sensitivity and spark energy can be affected by the component, temperature, and/or power supply variations. By using feedback to control the voltage used for flame detection as well as for spark generation, embodiments according to the application can decrease variations in the flame detection and spark generator voltage. In one embodiment, the regulation is provided to a mid-level voltage using a Pulse Width Modulation (PWM) based control. The pulse-width modulated (PWM) signal is used to generate and control high voltage. The parameters of the PWM signal can be set by a controller, and can be based on a mode of operation (e.g., current mode) and/or an output voltage.

FIG. 1 is a diagram that shows an embodiment of an ignition system according to the application. As shown in FIG. 1, an ignition system 100 can include a comparator 110, a controller 115, a voltage control circuit (e.g., PWM circuit) 120, a first voltage converter 130, a second voltage converter 140, a spark igniter 145, a flame sense circuit 155 and a HSI igniter 170 and a feedback circuit 160.

At a simplistic level, the ignition system 100 can generate a substantially constant spark voltage and/or flame sense voltage. The ignition system 100 can use feedback (e.g., closed loop feedback) to regulate the spark and flame sense voltage. In one embodiment, the controller 115 can monitor or detect the spark and flame sense voltage output, compare the spark and flame sense voltage output to a voltage set point, and/or adjust a PWM signal to control the DC/DC converter to maintain the spark and flame sense voltage output voltage substantially constant.

As shown in FIG. 1, the comparator 110 can receive at a first terminal a value representing a voltage set point 108 for a regulated voltage (e.g., mid-level voltage). Thus, the voltage set point 108 is a value representative of the regulated voltage. For example, the voltage set point 108 can be a value representative of 140V, 150V, 160V or the like. At a second terminal, the comparator 110 can receive a feedback 162 that can include a value or feedback signal representative of a state of the actual regulated voltage 132 (e.g., currently sensed) at this time. The comparator 110 can compare the voltage set point 108 value with the feedback 162 value to output an error signal 112 indicative of a difference, if any, between the inputted values.

The controller 115 can receive the error signal 112 and determine a correction value 118 to output to drive the regulated voltage 132 toward a desired or prescribed value. Thus, the controller 115 can operate to maintain the regulated voltage 132 or flame sense and spark voltage at a prescribed level. The controller 115 can operate to reduce the difference between the voltage set point 108 and the feedback 162.

The PWM circuit 120 is coupled to the controller 115 to receive the correction value 118 at an input terminal. The correction value 118 can be used by a modulator circuit to generate a control signal 122 for the first voltage converter 130. The control signal 122 output by the PWM circuit 120 can be a prescribed value or an increase/decrease signal. In one embodiment, the PWM circuit 120 as implemented can be a separate circuit or incorporated as a part of the controller 115.

In one embodiment, the first voltage converter 130 is a DC/DC converter that can receive an input voltage level and output a preset higher voltage level. As shown in FIG. 1, the first voltage converter 130 can receive an input voltage 138 and output the regulated voltage 132 or regulated flame sense and spark voltage. In one embodiment, the first voltage converter 130 can receive a DC voltage, a nominal DC voltage or 9-12 volts DC. In one embodiment, the first voltage converter 130 can receive the input voltage 138 from an optional input voltage regulator 135. The input voltage regulator 135 can receive a range of input values to output one or more different output voltage levels. Thus, the input voltage regulator 135 can receive an input voltage between 9-120V, 12-120V, 24-110V, 60V or any individual voltage level to output a preset voltage or range of voltage values (e.g., 9-12V, 24V, 60V, 50-75V, 120V).

The regulated voltage 132 can be set to a prescribed level or selected among a set of levels. In one embodiment, the regulated voltage level can be selected among a plurality of levels by the controller 115. The regulated voltage can be, for example, 120V, 140V, 160V. The regulated voltage 132 can be the regulated flame sense and spark voltage. In one embodiment, the regulated voltage 132 can be used for both of the spark voltage and the flame sense voltage. The regulated voltage 132 output by the first voltage converter 130 can be received by the second voltage converter 140, the flame sense circuit 155, and the feedback circuit 160.

The feedback circuit 160 can sense, monitor or is connected to receive the regulated output voltage 132 and is configured to output a representative value therefore in feedback 162. The feedback circuit 160 can output the feedback signal 162 as a scaled value, a quantized value, and/or a representative value of the regulated voltage 132. The feedback circuit 160 can receive and output an analog voltage level or a digital voltage level. In one embodiment, the feedback circuit 160 can pass an analog voltage level input through a voltage divider and convert the divided voltage to a digital voltage as a representative value of the regulated voltage 132.

As shown in FIG. 1, the second voltage converter 140 receives the regulated voltage 132 to output a spark voltage 142. In one embodiment, the second voltage converter 140 can be a step-up converter. The second voltage converter 140 can include a transformer having a secondary winding of 100×, 150×, 200×, to step up the input voltage by a factor of 100, 150, or 200 as known to one skilled in the art. The output voltage 142 or spark voltage from the second voltage converter 140 can be applied to a spark rod 145 to ignite a burner 150. The second voltage converter 140 can be used for a direct spark ignition (DSI) system. Alternatively, an HSI system 170 can be coupled to the burner 150.

To determine whether the burner 150 has been lit, a flame sense circuit 155 can be used. As known to one skilled in the art, a flame sense circuit 155 can be connected the burner 150 to output a signal indicative of whether the burner 150 is lit. In one embodiment, a non-zero signal 158 is indicative of a flame in the burner 150. The flame sense signal 158 can be transmitted to the controller 115.

In operation, the ignition system 100 can receive a command to light the burner 150. Preferably, the controller 115 can output an enable signal 116, 116' to the second voltage converter 140 and/or the HSI igniter 170. At the same time, the controller 115, PWM circuit 120, the first voltage converter 130, the feedback circuit 160 and the comparator 110 operate to supply the regulated voltage 132 at a prescribed level. The flame sense circuit 155 can use the regulated voltage 132 to continuously inform the controller 115 when the burner 150 is lit. When enabled, the second voltage regulator 140 uses the regulated voltage 132 to generate a spark voltage 142 to provide a spark to light the burner 150.

The ignition system 100 can use the regulated voltage control (e.g., for the flame sense and spark voltage) to maintain a stable or substantially constant flame sense voltage to reduce false flame detection in high EMI environment. Further, the ignition system 100 can generate (e.g., at all times) the same level of electromagnetic interference, which can be preferable for EMI noise sensitive applications. Variation in the regulated voltage 132 is reduced independently of input voltage variations or burner conditions such as temperature variations or the like in the ignition system 100. As described herein, the ignition system 100 can operate with a wide range of input voltages (e.g., ranging from 9 to 120V) and with both AC and DC input voltages using each of Direct Spark ignition (DSI) controls and Hot Surface Ignition (HSI) controls.

An embodiment of a method of flame sense voltage regulation for an ignition system according to the application will now be described. The method embodiment shown in FIG. 2, can be implemented in and will be described using a ignition system embodiment shown in FIG. 1, however, the method embodiment is not intended to be limited thereby.

Figure 2:
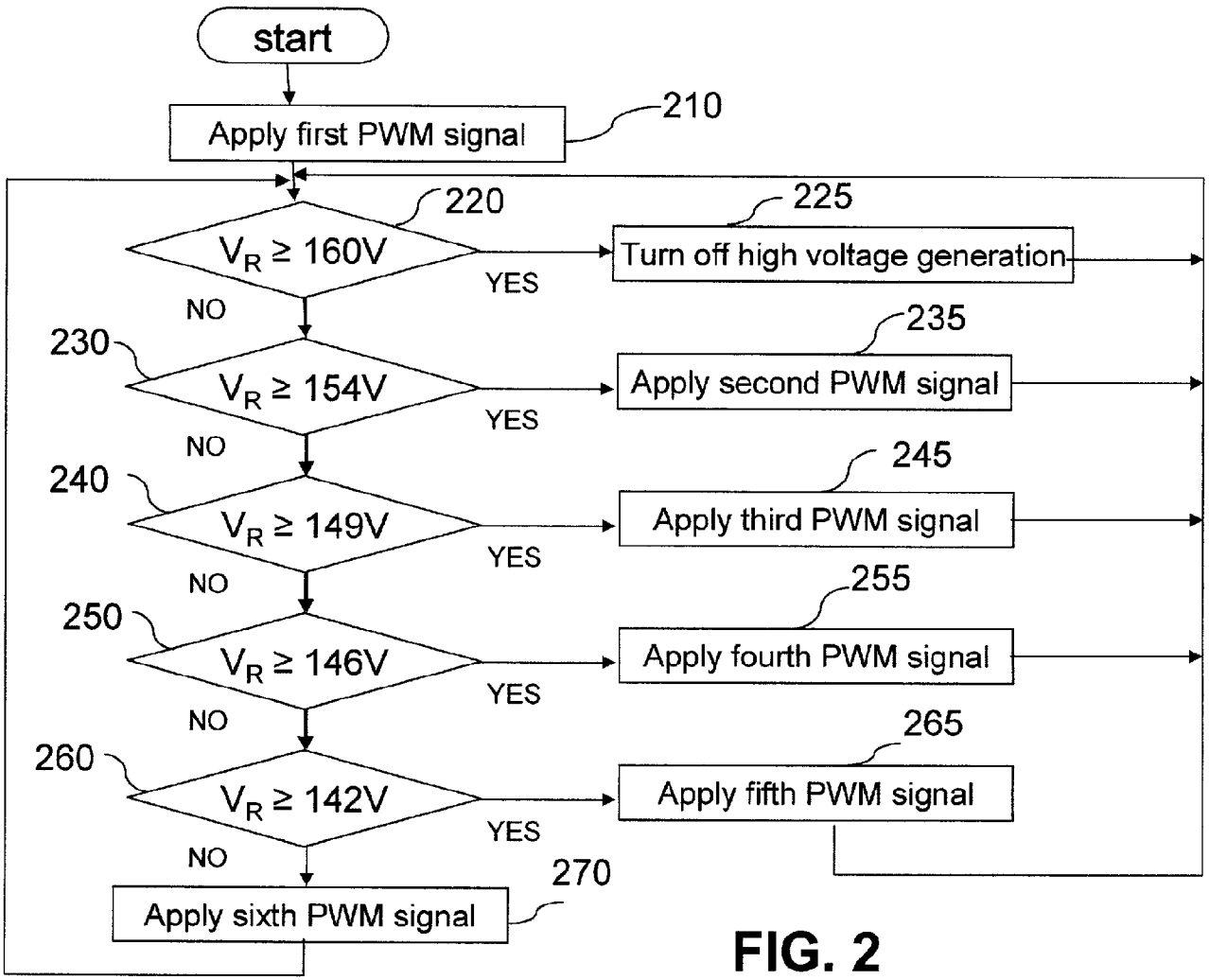
FIG. 2 is a flow diagram that shows an embodiment of a method for operating a spark ignition according to an embodiment of the application.

As shown in FIG. 2, after a process starts, a duty cycle of the PWM signal is set to a first value (e.g., a high or maximum value (such as 97.4%)) in order to generate an output voltage to the required level (160V) quickly or as soon as possible (operation block 210). The output voltage ($V_R$) or the regulated voltage 132 has an exemplary prescribed level of 160V as shown in FIG. 2. It can be determined whether the regulated voltage 132 (e.g., flame sense voltage and/or spark voltage) is greater than 160V (operation block 220). When the determination in operation block 220 is affirmative, the PWM signal is stopped (e.g., paused) to turn off the increase voltage generation (operation block 225).

When the determination in operation block 220 is negative, it can be determined whether the flame sense voltage is greater than 154V (operation block 230). When the determination in operation block 230 is affirmative, the duty cycle of the PWM signal is set to a second value such as 99.6% (operation block 235).

When the determination in operation block 230 is negative, it can be determined whether the flame sense voltage is greater than 149V (operation block 240). When the determination in operation block 240 is affirmative, the duty cycle of the PWM signal is set to a third value such as 99.4% (operation block 245).

When the determination in operation block 240 is negative, it can be determined whether the flame sense voltage is greater than 146V (operation block 250). When the determination in operation block 250 is affirmative, the duty cycle of the PWM signal is set to a fourth value such as 99.2% (operation block 255).

When the determination in operation block 250 is negative, it can be determined whether the flame sense voltage is greater than 142V (operation block 260). When the determination in operation block 260 is affirmative, the duty cycle of the PWM signal is set to a fifth value such as 98.6% (operation block 265). When the determination in operation block 260 is negative, set the duty cycle of the PWM signal to 97.8% (operation block 270) and control jumps back to operation block 220. The operation in FIG. 2 can continue while the burner (e.g., the burner 150) is enabled.

Although representative values were used in operations blocks 220, 230, 240, 250, 260, embodiments of the application are not intended to be limited thereby. Further, variability in the regulated voltage can be decreased or controlled by increasing the granularity of the exemplary method of FIG. 2. For example, a regulated voltage range in operation blocks 220, 230, 240, 250 and 260 can include a range of 160V-158V, 160V-155V, 160V-150V or 160V-130V. In one embodiment, a percentage of the regulated voltage can be used by the controller 115 to generate reference values for the method embodiment of FIG. 2. In one embodiment, the regulated voltage 132 can be controlled within 0.5%, 1%, 2% or less than 5% of the regulated voltage.

An embodiment of a method of operating an ignition system according to the application will now be described. The method embodiment shown in FIG. 3, can be implemented in and will be described using an ignition system embodiment shown in FIG. 1, however, the method embodiment is not intended to be limited thereby.

Figure 3:
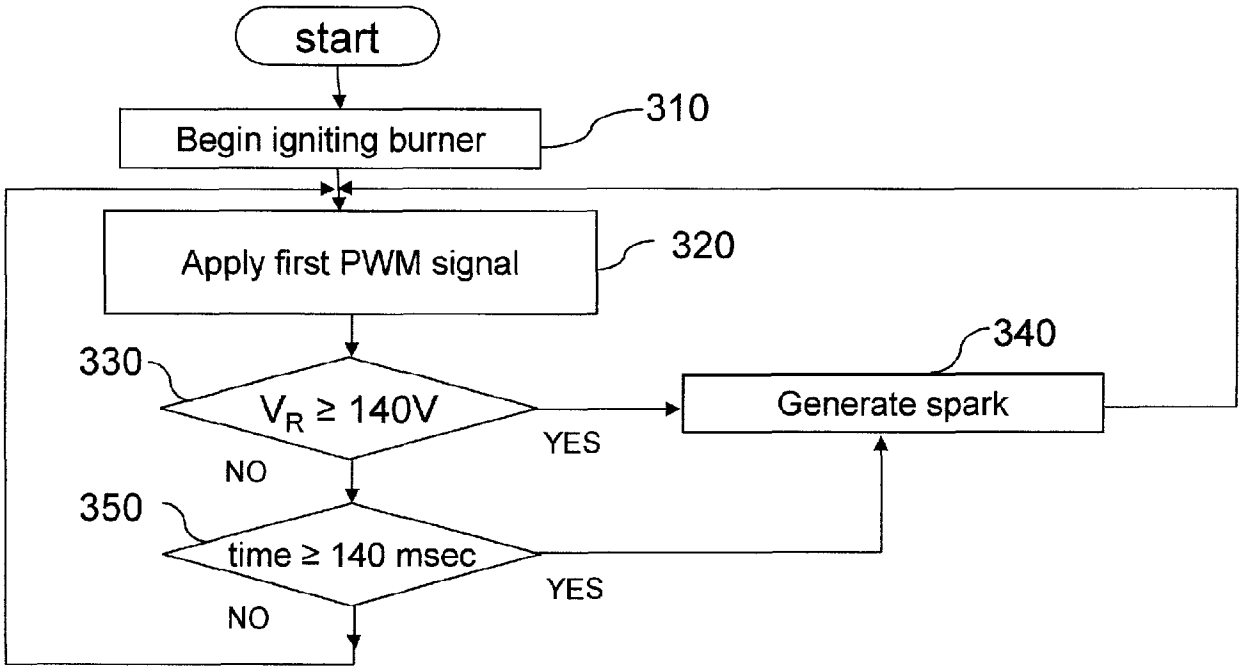
FIG. 3 is a flow diagram that shows an embodiment of a method for operating a flame sensing system according to an embodiment of the application.

As shown in FIG. 3, the exemplary method is applicable to DSI controls or a DSI ignition system. The flowchart on FIG. 3 illustrates the spark voltage regulation during a try an ignition period. After a process starts and ignition is enabled (operation block 310), a duty cycle of the PWM signal is set to a first value (e.g., a high or maximum value (such as 97.4%)) in order to generate an output voltage to the required level (e.g., 140V) quickly or as soon as possible (operation block 320). Thus, the duty cycle of the PWM signal is set to get the maximum energy from a coil of the first voltage converter 130 (operation block 320).

It can be determined whether the regulated voltage (e.g., spark ignition voltage) is greater than 140V (operation block 330). When the determination in operation block 330 is affirmative, the controller generates a spark since the voltage has reached the required spark generation level (e.g., 140V) (operation block 340). When the determination in operation block 330 is negative, it can be determined whether a prescribed time period (e.g., 140 msec) has elapsed (operation block 350). When the determination in operation block 350 is affirmative, control passes to operation block 340, otherwise control jumps back to operation block 320. Thus, in one embodiment, even though the output voltage does not reach its prescribed level within the 140 ms, the spark is generated to discharge accumulated energy. Operations in FIG. 3 can be repeated. For example, operations in FIG. 3 can be repeated until a disable command is received or when the burner is lit.

An embodiment of a method of operating an ignition system according to the application will now be described. The method embodiment shown in FIG. 4, can be implemented in and will be described using an ignition system embodiment shown in FIG. 1, however, the method embodiment is not intended to be limited thereby.

Figure 4:
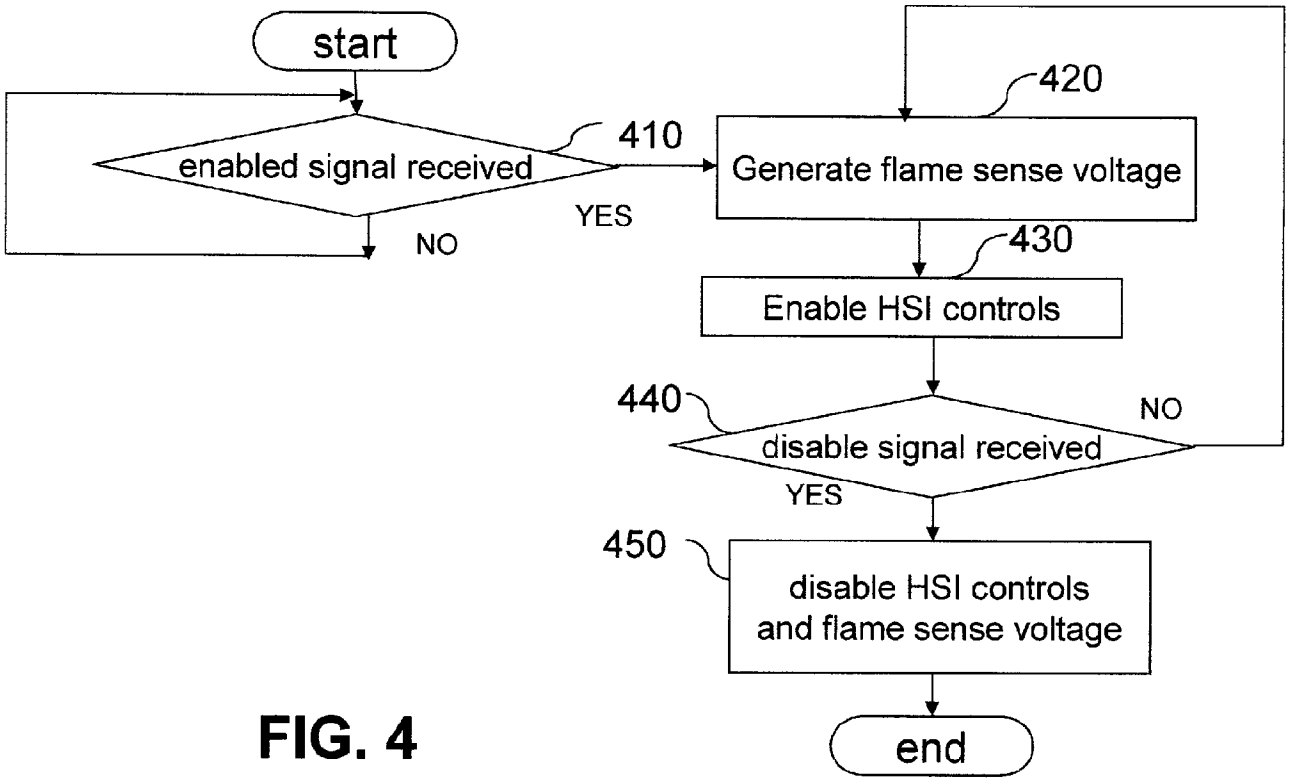
FIG. 4 is a flow diagram that shows an embodiment of a method for operating a flame sensing system according to an embodiment of the application.

As shown in FIG. 4, the exemplary method is applicable to HSI controls or a HSI ignition system. The flowchart on FIG. 4 illustrates the flame sense voltage regulation during a try for ignition period. After a process starts and ignition is enabled (operation block 410), an output voltage is generated to the prescribed level (e.g., 150V) (operation block 420). In one embodiment, a flame sense detector can provide an indication to the controller 115 upon receiving the generated flame sense voltage whether a flame is lit. Those skilled in the art will recognize that various types of flame detection devices, other than of the flame electrode with rectification circuit type, may be employed in the ignition control of embodiments according to the application. Then, the enable signal is provided to the HSI controls such as from the controller 115 (operation block 430).

It can be determined whether the disable signal is received (operation block 440). When the determination in operation block 440 is negative, control jumps to operation block 420. When the determination in operation block 440 is affirmative, the disable signal is provided to the HSI controls such as from the controller 115 (operation block 450) and the process can end.

Embodiments of apparatus and/or methods according to the application can provide stable flame sense that is not affected by the temperature, component, and power supply voltage variations. Embodiments of apparatus and methods according to the application can reduce customer nuisance or service calls attributable to variations on component tolerancing within the gas ignition control (e.g., during temperature and/or voltage extremes.

Embodiments of apparatus and/or methods according to the application can provide increased safety and reliability. Embodiments of apparatus and/or methods according to the application can provide gas ignition control better able to compensate for small variations in the spark transformer performance (e.g., second voltage converter). Embodiments of apparatus and/or methods according to the application can provide a more consistent spark energy for the end user regardless of system variations caused by temperature or voltage or components within the gas ignition control.

Embodiments of the application have been described herein with reference to a DSI and/or HSI system. However, embodiments of the application are not intended to be so limited. For example, embodiments of systems or methods according to the application can be configured to operate with other spark ignition systems such as interrupted pilot, intermittent pilot ignition or intermittent spark ignition pilot systems or the like. For example, embodiments of systems or methods according to the application can operate with proven hot surface ignition systems, intermittent hot surface, ignition pilot systems or the like.

While embodiments of the application has been particularly shown and described with reference to the exemplary embodiments as illustrated in the drawings, it will be recognized by those skilled in the art that various modifications may be made without departing from the spirit and scope of the application. For example, exemplary embodiments of apparatus and methods have been described with reference to a gas burner, however, ignition systems are known to one skilled in the art to include but not be limited to residential or commercial gas appliances, such as, for example, gas furnaces, boilers, water heaters and commercial cooking equipment, which can also be used with vehicle systems and/or fuel cell systems. Further, exemplary embodiments of apparatus and methods have been described with reference to a gas as a fuel, however it should be noted that other fuels may be used including but not limited to propane, natural gas, oil or the like. For example, the ignition control and the method of the invention may be used in connection with combinations of fuel and ignition sources, other than the exemplary gas and spark igniter embodiment described hereinbefore, such as for example fuel oil and a high temperature igniter. Also, ignition systems have been used with related devices such as but not limited to fuel cell applications or systems.

It will be appreciated that, in various of the above-disclosed and other features and functions, or alternatives thereof, such as but not limited to the controller 115 may be implemented on a programmed microprocessor, a microcontroller, an integrated circuit element such as ASIC, PLD, PLA, FPGA, or PAL, or the like, a hardwired electronic or logic circuit, or a programmable logic device that can perform at least the functionality shown in FIGS. 2-4.

U.S. Pat. No. 4,626,193 illustrates a method to boost voltage using a self-oscillator and a step-up transformer and U.S. Pat. No. 6,222,719 illustrates a method to boost voltage using a low cost DC/DC converter, which are hereby incorporated by reference in their entirety.

Also, it is to be understood that the phraseology and terminology used herein is for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled," and variations thereof are used broadly and encompass both direct and indirect mountings, connections, supports, and couplings. Further, "connected" and "coupled" are not restricted to physical or mechanical connections or couplings.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been set forth, it will be understood that features and aspects that have been described with reference to each particular embodiment can be used with each remaining particularly set forth embodiment. For example, features or aspects described with respect to FIG. 1 can be used, combined with or replace features described using FIGS. 2-4.

We claim:

1. A spark ignition system comprising:

a comparator to compare a first voltage set point and a feedback value to output a difference value;

a controller to receive the difference value of the comparator to generate a correction signal;

a pulse width modulation (PWM) circuit coupled to the controller to receive the correction signal and configured to generate an output voltage level;

a DC/DC voltage converter coupled to receive the output voltage level from the PWM circuit and configured to generate a regulated flame sense and spark voltage;

a flame sense circuit coupled to receive the regulated flame sense and spark voltage and configured to detect a status of a burner flame, the flame sense circuit to output a sensed flame signal to the controller;

a feedback circuit coupled to receive the regulated flame sense and spark voltage and generate the feedback value representative of a current regulated flame sense and spark voltage level for output to the comparator; and a second voltage converter coupled to the controller and coupled to receive the regulated flame sense and spark voltage, the second voltage converter to output an increased corresponding voltage for a spark igniter, the controller to regulate the regulated flame sense and spark voltage to a prescribed level.

2. The spark ignition system of claim 1, wherein the regulated flame sense and spark voltage is a reference level comprising 100 volts, 120 volts, 130 volts, 140 volts, 150 volts 160 volts, or 200 volts.

3. The spark ignition system of claim 1, wherein the regulated flame sense and spark voltage is regulated within 1 volt, 2 volts, or less than 5 volts of the prescribed level.

4. The spark ignition system of claim 1, wherein the regulated flame sense and spark voltage is regulated to less than 1%, 2% or 5% of the prescribed level.

5. The spark ignition system of claim 1, comprising an input voltage regulator to receive a first voltage level and configured to output the input voltage to the first voltage regulator.

6. The spark ignition system of claim 5, wherein the first voltage level is between 9 volts and 120 volts.

7. A method of operating an ignition system comprising:

comparing a voltage set point with a feedback signal to output a first control signal;

generating a voltage level control signal responsive to the first control signal;

converting an input voltage to a regulated control voltage using a first voltage converter, where said converting is responsive to the voltage level control signal;

detecting a status of a burner flame using the regulated control voltage to output a sensed flame signal to a controller;

receiving the regulated control voltage and generating the feedback signal using a feedback circuit; and receiving the regulated control voltage and converting the regulated control voltage to a spark voltage for a direct spark igniter using a second voltage converter.

8. The method of claim 7, comprising operating in a first mode using a first level regulated control voltage; and operating in a second mode using a second level regulated control voltage, when the second level regulated control voltage is set independent of EMI.

9. An ignition system comprising:

a comparator to compare a first voltage set point and a feedback value to output a correction value;

a controller to receive the correction value of the comparator to generate a control signal;

a voltage controller circuit coupled to the controller to receive the control signal and configured to generate an output voltage level;

a DC/DC voltage converter coupled to receive the output voltage level from the voltage controller circuit and configured to generate a regulated voltage;

a flame sense circuit coupled to receive the regulated voltage and configured to detect a status of a burner flame, the flame sense circuit to output a sensed flame signal to the controller;

a feedback circuit coupled to receive the regulated voltage and generate the feedback value representative of a current regulated voltage level; and a second voltage converter coupled to the controller and coupled to receive an enable signal from the controller, the second voltage converter to output a corresponding voltage for an igniter circuit, the controller to regulate the regulated voltage to a prescribed level responsive to the feedback value.

10. The ignition system of claim 9, wherein the second voltage converter is an ignition transformer coupled to receive the regulated voltage, the ignition transformer to output a corresponding voltage increased 50×, 100×, 150× or 200× relative to the regulated voltage to an arc spark igniter circuit.

11. The ignition system of claim 9, wherein the second voltage converter is an hot surface igniter circuit comprising an ignition element operatively coupled to the igniter circuit.

12. The ignition system of claim 9, comprising an input voltage regulator to receive a first voltage level and configured to output the input voltage to the first voltage regulator, where the first voltage level is between 9 volts and 120 volts.

13. The ignition system of claim 9, wherein the regulated voltage is regulated within 1 volt, 2 volts or 5 volts of the prescribed level.

14. The ignition system of claim 9, wherein the regulated voltage is regulated within less than 1%, 2% or 5% of the prescribed level.

* * * * *